United States Patent [19]

Gutschmit

[11] Patent Number: 4,905,340

[45] Date of Patent: Mar. 6, 1990

[54] LINT CONTROL APPARATUS

[76] Inventor: Alan Gutschmit, P.O. Box 708, Troy, N.C. 27371

[21] Appl. No.: 231,226

[22] Filed: Aug. 11, 1988

[51] Int. Cl.[4] ..... A47L 5/14

[52] U.S. Cl. ..... 15/316 R; 15/312 R; 15/345; 55/467; 55/471

[58] Field of Search ..... 15/312 R, 316 R, 316 A, 15/345, 346; 55/379, 471, 473, 469, 467

[56] References Cited

U.S. PATENT DOCUMENTS

| | | | |
|---|---|---|---|
| 2,313,676 | 3/1943 | Shaver | 55/471 X |
| 2,845,303 | 7/1958 | King | 15/312 R X |
| 2,976,558 | 3/1961 | Fain | 55/471 X |
| 3,271,936 | 9/1966 | Dauge | 55/471 X |
| 3,563,004 | 2/1971 | Schouw | 55/103 |
| 3,667,093 | 6/1972 | Culpepper | 15/301 X |
| 4,366,525 | 12/1982 | Baumgartner | 55/410 X |
| 4,685,169 | 8/1987 | Nelson | 15/312 R X |

FOREIGN PATENT DOCUMENTS

| | | | |
|---|---|---|---|
| 1079931 | 4/1960 | Fed. Rep. of Germany | 55/471 |

OTHER PUBLICATIONS

"Lint Trap 500", publ. by Modufil, Inc., Jan. 1985.
"Modufil 3450", publ. by Modufil, Inc., Jan. 1985.

*Primary Examiner*—Chris K. Moore
*Attorney, Agent, or Firm*—Shefte, Pinckney & Sawyer

[57] ABSTRACT

A lint control apparatus particularly adapted for textile plants includes a cylindrical filter with filter media about its circumferential periphery, a coaxial fan for drawing ambient air from the workplace radially through the filter media into the filter housing, and an upstanding duct for directing the air exhaust upwardly at overhead surfaces to blow lint therefrom and limit further lint accumulation thereon. The apparatus is adapted to be freestanding on a floor surface of the work area, with an interior baffle within the filter housing effectively concentrating the ambient air draw along the floor surface. The upstanding duct may have a deflector member which is movable through a predetermined course to direct the discharged air over a predetermined overhead area.

17 Claims, 4 Drawing Sheets

LINT CONTROL APPARATUS

BACKGROUND OF THE INVENTION

The present invention relates to apparatus for controlling lint and dust in workplaces, for example, textile plants, and relates more specifically to an apparatus particularly adapted for collecting airborne lint from a work area and for limiting lint accumulation on overhead surfaces thereabove.

At substantially all stages of the processing of textile fibers, particularly cotton, from the initial fiber cleaning and preparation stage through yarn spinning and fabric production, the necessary handling of the textile fibers and yarns inherently liberates minute pieces of fiber, commonly referred to as lint, as well as other particulate dust and debris which tend to become readily airborne within the work area of the textile processing plant and ultimately to settle and accumulate on machinery and other exposed surfaces within the plant interior. Lint, dust and other such debris pose a variety of problems to the textile manufacturer. First, workers are continuously subjected to the inhalation of airborne lint and the like which, at concentration levels often produced in textile cotton processing plants, poses a potential hazard that workers may develop respiratory problems, such as "brown lung" disease, as a result of extended exposure. Secondly, in yarn spinning and fabric production operations, airborne lint and dust which settle on the processing machinery or yarn being processed or utilized may cause machine stoppages as well as defects in the yarn or fabric produced, which utlimately adversely affects operating efficiency and revenues. Finally, apart from the foregoing problems, textile plants which generate lint and other debris require periodic cleaning of accumulations thereof from processing machinery as well as virtually all exposed interior plant surfaces, which generally is a labor-intensive and therefore relatively expensive matter.

Conventional attempts to control airborne lint and lint accumulation have been directed, to a large extent, to the filtration of lint-laden air, for example, by continuously withdrawing and filtering the lint-laden air from the workplace and replacing it with clean filtered or outside air. However, lint filtration is effective only to the extent of reducing to varying degrees the concentration of airborne lint and the rate of lint accumulation. In practice, it is extremely difficult to control the conveyance of airborne lint by a moving air flow in a relatively open environment such as a textile processing plant due to the minute size and light weight nature of lint which makes it highly reactive to air turbulence. As a result, relatively high filtration air flow rates are necessary to entrain and transport any significant proportion of airborne lint in typical textile mill work environments, which generally is impractical. Accordingly, typical centralized lint filtration systems in textile plants generally do not extract a high proportion of airborne lint and like debris.

One conventional alternative to a centralized filtration system for an entire textile plant is to provide individual filter modules strategically located at a number of locations throughout the plant to attempt to collect airborne lint and debris close to the location of lint generation. An example of this type of so-called modular filtration system is manufactured by ModuFil, Inc., of Knoxville, Tenn., under the model designation "Lint Trap 5000." Each filter module basically comprises a free-standing cylindrical filter with a fan coaxially mounted interiorly between a lower filter section and an upper exhaust section. The fan draws ambient lint-laden air radially inwardly through the circumference of the filter section and returns the filtered air radially outwardly through the circumference of the exhaust section. While this filter apparatus is reasonably effective for lint control within a localized work area, the radially inward and outward air circulation created by the apparatus limits its effectiveness to only the ambient area laterally adjacent the apparatus with essentially no effect on airborne and accumulated lint within elevated areas of the workplace overhead.

SUMMARY OF THE INVENTION

It is accordingly an object of the present invention to provide an improved lint control apparatus which is particularly adapted not only for collecting airborne lint from a work area in a textile plant but also for limiting accumulation of lint on overhead surfaces above the work area.

Briefly summarized, the present lint control apparatus basically comprises a filter housing defining an air inlet and an air outlet with lint filtering media covering the air inlet and a fan arrangement for drawing ambient air from the work area through the filter media and exhausting the air through the air outlet. The filter media is thereby adapted to separate airborne lint from the ambient air and collect the separated lint for disposal. In addition, a generally upstanding duct communicates with the air outlet of the filter housing for directing the exhausted air upwardly at overhead surfaces to blow accumulated lint off the overhead surfaces and limit further lint accumulation thereon.

In the preferred embodiment of the present lint control apparatus, the filter housing is cylindrical with a permeable circumferential periphery defining an air inlet annularly into the housing, the lint filtering media covering the air inlet circumferentially about the filter housing. One axial end of the cylindrical housing is adapted for supporting the housing on a floor surface of the work area with the air outlet from the housing being formed coaxially with the other axial end of the housing. A cylindrical baffle depends coaxially within the housing from its other axial end in communication with the air outlet, with an inlet end of the baffle being relatively closely spaced to the one axial end of the housing to be relatively closely spaced to the floor of the work area. The fan arrangement is mounted coaxially with the air outlet for drawing ambient air from the work area generally radially through the filter media and exhausting the air upwardly through the baffle and the air outlet. In this manner, the baffle is effective to generally concentrate the ambient air draw of the fan arrangement along the floor of the work area. The upstanding duct is mounted coaxially in communication with the air outlet of the filter housing and the fan arrangement. The duct preferably includes a movable deflector member with a suitable means being provided for moving the deflector member in a predetermined course to direct the exhausted air over a predetermined overhead area. For example, the deflector member of the duct may be arranged to be pivotably reciprocated in a back-and-forth pattern.

DESCRIPTION OF THE PREFERRED EMBODIMENT

Figure 1:
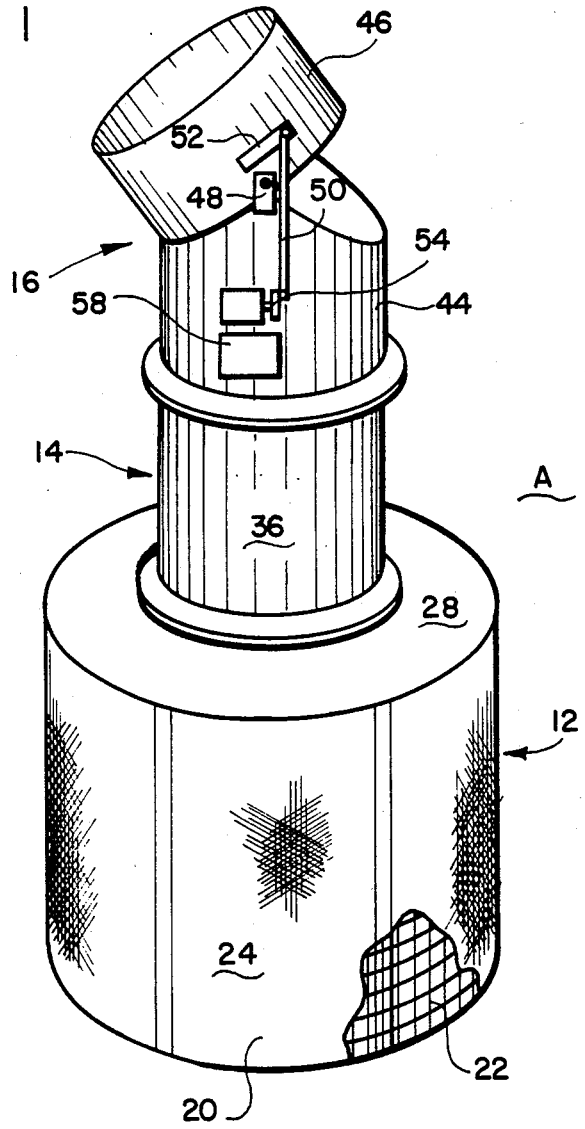
FIG. 1 is a perspective view of a lint control apparatus according to the preferred embodiment of the present invention.

Referring now to the accompanying drawings and initially to FIG. 1, the lint control apparatus according to the preferred embodiment of the present invention is shown generally at 10 and basically includes a cylindrical filter indicated generally at 12, a fan indicated generally at 14, and an exhaust duct assembly generally indicated at 16, assembled in coaxial alignment with one another.

Figure 2:
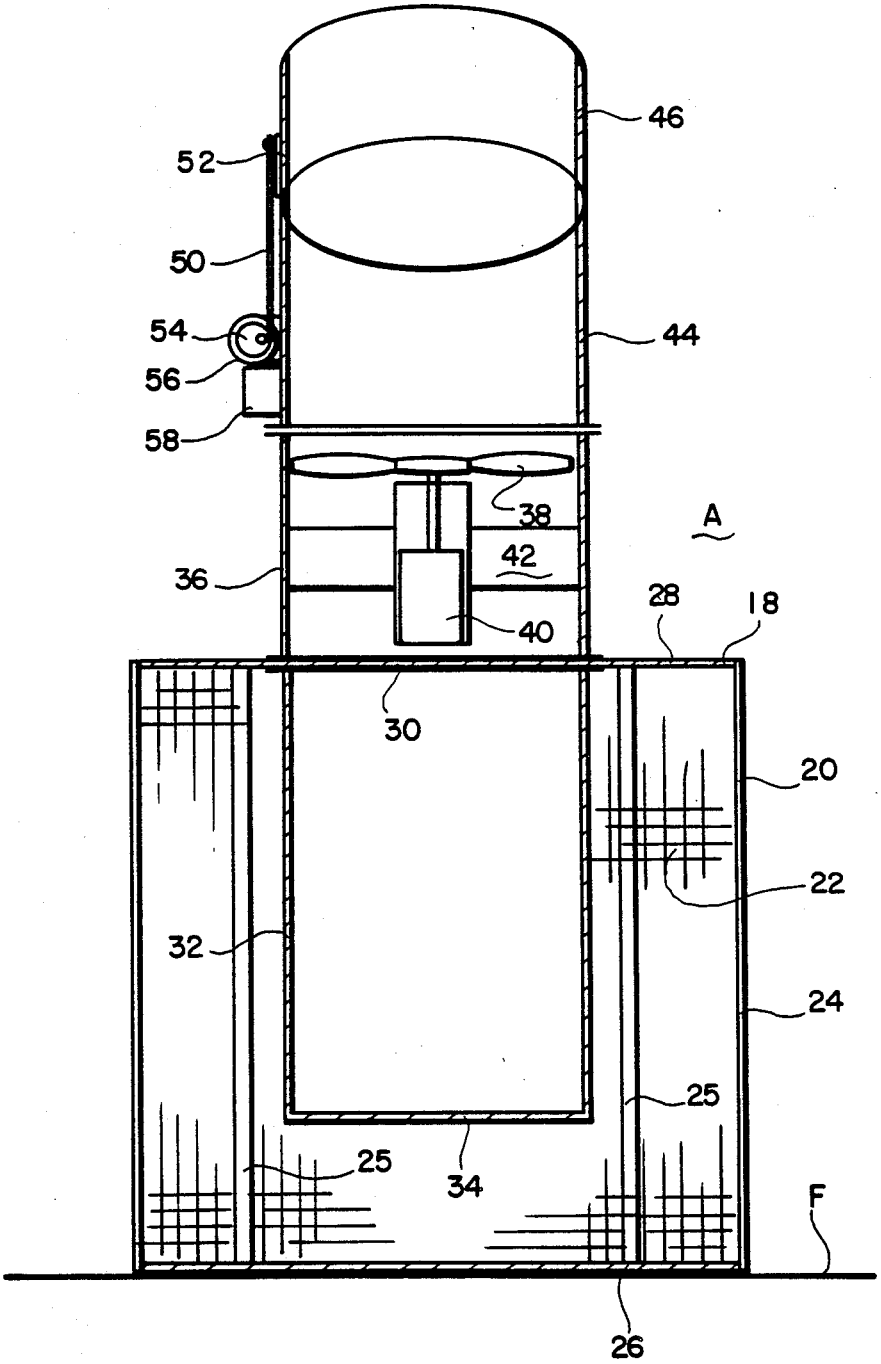
FIG. 2 is a vertical cross-sectional view of the lint control apparatus of FIG. 1 taken along line 2—2 thereof.

As best seen in FIG. 2, the filter 12 includes a cylindrical filter housing 18 having circular end walls 26,28 at the opposite axial ends of the filter housing with a plurality of support struts 25 extending in spaced parallel relation axially between the outer peripheral edges of the end walls 26,28. The filter housing 18 thus has a substantially open circumferential periphery which is covered by a suitably permeable lint filtering media 20, preferably in the form of an inner cylindrical layer of large mesh wire fabric 22 to provide structural support for an outer layer of fine mesh wire filter cloth 24. Preferably, the filter cloth 24 is affixed to the outward surface of the filter housing 18 to facilitate ready removal and replacement as necessary or desirable. Thus, the entire circumferential periphery of the filter housing 18 forms an air inlet into the housing interior through the filter layers 22,24 of the filter media 20. The circular end wall 26 encloses one axial end of the filter housing 18 for upstanding support of the filter 12 on a floor surface F in a work area A wherein the lint control apparatus 10 is to be utilized. The opposite circular end wall 28 is centrally formed with a circular opening 30 forming an air outlet from the interior of the filter housing 18. An imperforate hollow cylindrical baffle 32 of a lesser axial dimension than the filter housing 18 is mounted interiorly within the filter housing 18 to the interior surface of the end wall 28 coaxially about its outlet opening 30 to extend therefrom to a terminal inlet end 34 of the baffle 32 spaced from the end wall 26 of the filter 12. The axial dimension of the baffle 32 in relation to that of the filter housing 18 is a matter of selection according to the needs and desires of the user in each particular filter application, but it is generally preferable that the baffle 32 be of an axial dimension in the range of approximately two-thirds to three-quarters of the axial dimension of the filter housing 18.

The fan 14 is of the conventional so-called tubeaxial type having a tubular cylindrical housing 36 within which a paddle wheel 38 and an electrical drive motor 40 are coaxially supported by radial struts 42 for driven rotation of the paddle wheel 38 to produce a moving flow of air axially through the fan housing 36. The suction end of the fan housing 36 is mounted exteriorly to the end wall 28 of the filter housing 18 coaxially with its outlet opening 30, whereby the fan 14 is operative to draw ambient air inwardly into the filter housing 18 through the filter media 20 and upwardly through the baffle 32 and the outlet opening 30 of the filter housing 18, all as more fully explained hereinafter.

The exhaust duct assembly 16 includes a tubular cylindrical duct member 44 fixedly mounted stationarily to the outlet end of the fan housing 36 coaxially therewith to receive the ambient air flow exhaust by the fan 14 from the filter housing 18. The outward end of the stationary duct member 44 is tapered axially outwardly away from the fan 14 and filter 12 and has a movable discharge deflector in the form of a cylindrical discharge duct member 46 pivotably mounted thereto by a pair of brackets 48 for pivotal movement of the discharge duct member 46 with respect to the stationary duct member 44 through an angular range of movement defined by the tapered configuration of the stationary duct member 44. The discharge duct member 46 is driven reciprocally through this range of pivotal movement by a drive arm 50 pivotably affixed at one end to a connecting link 52 fixed to one of the pivot brackets 48 and at the opposite end eccentrically to a crank wheel 54 driven by an electric drive motor 56.

Operative control of the electric drive motor 40 of the fan 14 and of the electric drive motor 56 to the discharge duct member 46 is provided through suitable control buttons provided at a control box representatively shown at 58 mounted exteriorly to the fan housing 36.

In operation, the lint control apparatus 10 is arranged in free-standing upright disposition with the end wall 26 of its filter housing 18 supported on a floor surface F in a work area A wherein airborne lint or other dust or debris is generated which is necessary or desirable to be extracted from the ambient air, such as a conventional textile mill or plant involved in the processing or handling of cotton fiber or yarn. Energization of the drive motor 40 to rotate the paddle wheel 38 of the fan 14 is effective as aforementioned to draw ambient air from the work area A generally radially inwardly into the interior of the filter housing 18 through its filter media 20 and to exhaust the air from within the filter housing 18 upwardly through the interior of the baffle 32 and outwardly through the outlet opening 30. The filter clothing 24 of the filter media 20 is effective to separate airborne lint from the ambient air as it is drawn into the filter housing 18 to cause the separated lint to collect over the surface of the filter clothing 24 for removal and disposal. The arrangement of the inlet end 34 of the baffle 32 in relatively closely spaced relationship to the end wall 26 of the filter housing 18 orients the inlet baffle end 34 at a correspondingly close spacing to the floor surface F to effectively concentrate the ambient air draw of the fan 14 along the floor surface F of the work area A. In this manner, a greater suction draw force is applied along the floor surface F whereat a greater concentration of airborne lint normally exists in that the lint naturally tends to ultimately graviate toward the floor surface F and thereby a more effective lint collection is achieved than without the provision of a baffle 32. Additionally, this arrangement of the baffle 32 basically causes the collected lint to build on the exterior surface of the filter media 20 generally in an upward direction so that the level of lint buildup on the filter media 20 provides a visual indicator as to when cleaning of the collected lint from the filter media 20 is needed.

The ambient air drawn through the filter housing 18 is continuously exhausted upwardly through the upstanding duct members 44,46 toward the area immediately above the lint control apparatus 10 to be effective to blow accumulated lint, dust and debris off of overhead surfaces on which upwardly migrating airborne lint typically tends to settle, e.g. overhead light fixtures, heating and air conditioning ductwork, ceiling beams, and like surfaces. Furthermore, the upward direction of the air flow discharge from the lint control apparatus 10 is effective to blow any airborne lint, dust and other debris within the overhead area to limit any tendency of such lint and debris to settle and accumulate on these overhead surfaces. The continuous reciprocation of the discharge duct member 46 by the drive linkage operated by the drive motor 56 is effective to deflect the discharged air flow in a predetermined back-and-forth course to achieve this effect over a predetermined overhead area in the vicinity of the lint control apparatus 10. It will thus be understood that, advantageously and in contrast to conventional lint filtering apparatus, the lint control apparatus of the present invention is not only effective for separating and collecting airborne lint from a work place but is also uniquely adapted to limit accumulation of upwardly migrating lint on overhead surfaces above the actual work area. For maximum effectiveness in a relatively large lint-generating work area such as a textile mill, a plurality of the lint control apparatus 10 would preferably be positioned at strategic locations throughout the work area, the necessary or desirable number of the lint control apparatus 10 being a function of the size of the work area, the amount of lint generated and other relevant variable factors.

Figure 3:
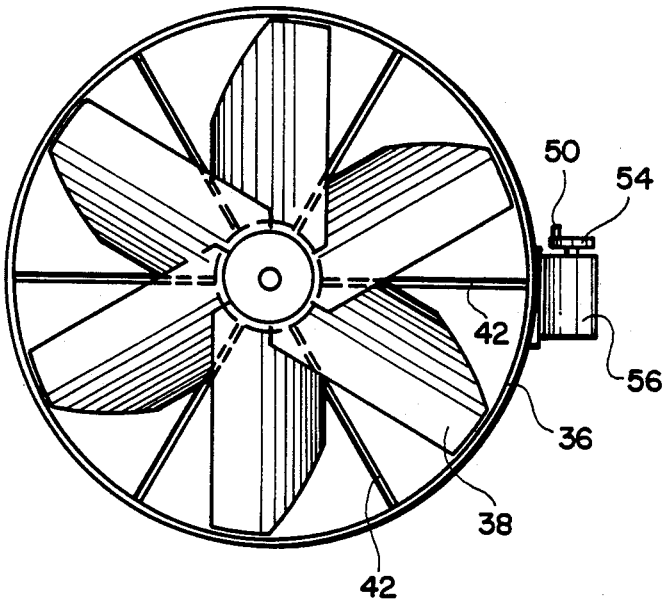
FIG. 3 is a horizontal cross-sectional view of the lint control apparatus taken along line 3—3 of FIG. 2.
Figure 4:
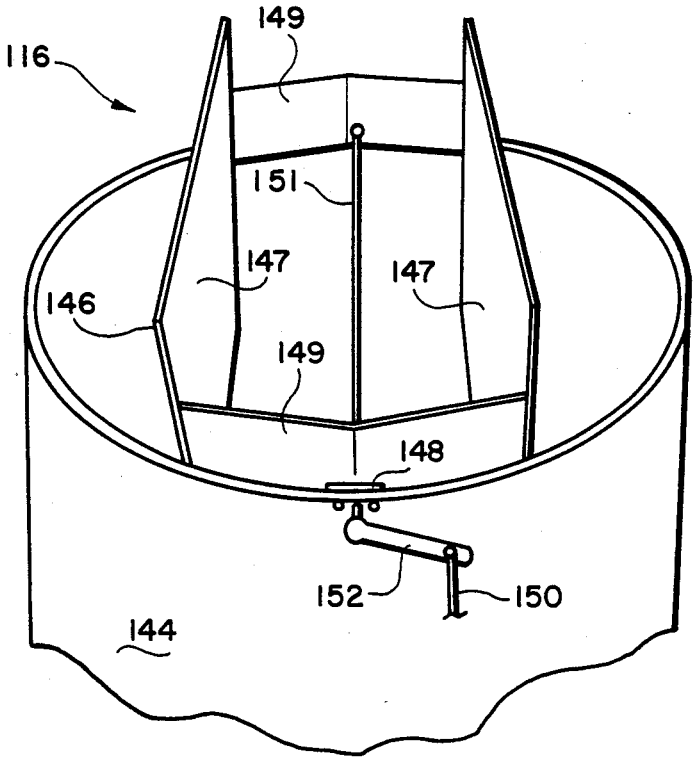
FIG. 4 is a top perspective view of an alternate embodiment of the discharge duct assembly of the lint control apparatus of the present invention.

Referring now to FIG. 4 of the accompanying drawings, an alternate embodiment of the exhaust duct assembly of the present lint control apparatus is generally indicated at 116. The exhaust duct assembly 116 includes a tubular cylindrical duct member 144 fixedly mounted in stationary upstanding disposition to the outlet end of the fan housing (not shown) coaxially therewith to receive the ambient air flow exhausted by the fan from the filter housing (also not shown), as in the embodiment of FIGS. 1–3. The duct member 144 is preferably of an axial dimension approximately the same as the combined axial dimension of the duct members 44 and 46 of the embodiment of FIGS. 1–3 and, instead of the duct member 46 of such embodiment, a louver assembly 146 is pivotably mounted interiorly of the duct member 144 at its upper discharge end. The louver assembly 146 has a pair of louver plates 147 fixed in spaced parallel relation to one another by a pair of transverse supports 149 extending between the respective opposite ends of the louver plates 147. A pivot shaft 150 extends tranversely between the supports 149 intermediate the louver plates 147 in parallel relation therewith, with the opposite ends of the pivot shaft 151 being supported by a pair of pivot supports 148 affixed to the upper end of the duct member 144 at diametrically opposite locations to pivotably dispose the louver assembly 146 within the upper interior of the duct member 144. A connecting link 152 is fixed at one end to the pivot shaft 151 and at the opposite end to a drive arm 150 which, in turn, is affixed eccentrically to an electrically driven crank wheel (not shown) as in the embodiment of FIGS. 1–3. In this manner, the louver assembly 146 is reciprocably driven in a back-and-forth fashion within the upper end of the duct member 44 to deflect the discharge air flow from the lint control apparatus in a corresponding back-and-forth course over a predetermined overhead area in the vicinity of the lint control apparatus.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. Lint control apparatus particularly adapted for collecting airborne lint from a work area in a textile plant, and for limiting accumulation of lint on overhead surfaces above the work area, said lint control apparatus comprising a filter housing defining an air inlet and an air outlet, lint filtering media covering said air inlet, fan means for drawing ambient air from the work area through said filter media and exhausting the air through said air outlet, said filter media being adapted to separate airborne lint from the ambient air and collect the separated lint for disposal, said air inlet extending annularly about said filter housing for lint collection from a full 360° range of the ambient work area, said filter housing being adapted to be floor-supported in the work area for disposition of said annular air inlet adjacent the work area floor, and duct means communicating with said air outlet of said filter housing for directing the air exhausted upwardly at overhead surfaces to blow accumulated lint off the overhead surfaces and limit further lint accumulation thereon.

2. Lint control apparatus according to claim 1 and characterized further in that said air outlet of said filter housing is located centrally with respect to said annular air inlet.

3. Lint control apparatus according to claim 1 and characterized further in that said filter housing is substantially cylindrical with said air inlet extending about the circumferential periphery thereof for generally radial flow of ambient air through said filter media.

4. Lint control apparatus according to claim 1 and characterized further in that said filter housing includes means for concentrating the ambient air draw of said fan means along the work area floor.

5. Lint control apparatus according to claim 4 and characterized further in that said concentrating means comprises a tubular baffle extending within said filter housing from said air outlet to an inlet end of said baffle disposed generally centrally of said air inlet at a relatively close spacing to the work area floor, said fans means being arranged in communication with the interior of said baffle.

6. Lint control apparatus according to claim 1 and characterized further in that said duct means includes movable deflector means at an upper discharge end for selective changeability of the upward direction of the exhausted air.

7. Lint control apparatus according to claim 6 and characterized further by means for moving said deflector means in a predetermined course to direct the exhausted air over a predetermined overhead area.

8. Lint control apparatus according to claim 7 and characterized further in that said deflector means is arranged for pivotal movement, said moving means being arranged for pivotably reciprocating said deflector means in a back-and-forth pattern.

9. Lint control apparatus particularly adapted for collecting airborne lint from a work area in a textile plant and for limiting accumulation of lint on overhead surfaces above the work area, said lint control apparatus comprising a filter housing adapted to be supported at one end on a floor surface of the work area, said filter housing having an annular air inlet into said housing and having an air outlet formed at the other end of said housing, lint filtering media covering said air inlet annularly about said filter housing, fan means mounted in communication with said air outlet of said filter housing for drawing ambient air from the work area generally laterally through said filter media and exhausting the air upwardly through said air outlet of said filter housing, said filter media being adapted to separate airborne lint from the ambient air and collect the separated lint for disposal, and generally upstanding duct means mounted in general alignment with said air outlet of said filter housing and said fan means in communication therewith for directing the exhausted air upwardly at overhead surfaces to blow accumulated lint off the overhead surfaces and limit further lint accumulation thereon, said duct means including movable deflector means at an upper discharge end for selective changeability of the upward direction of the exhausted air.

10. Lint control apparatus according to claim 9 and characterized further in that said filter housing includes a tubular baffle depending therewithin from said other end of said filter housing in communication with said air outlet to an inlet end of said baffle at a relatively close spacing to said one axial end of said filter housing to be relatively closely spaced to the work area floor surface, said baffle being effective to generally concentrate the ambient air draw of said fan means along the work area floor surface.

11. Lint control apparatus according to claim 9 and characterized further by means for moving said deflector means in a predetermined course to direct the exhausted air over a predetermined overhead area.

12. Lint control apparatus particularly adapted for collecting airborne lint from a work area in a textile plant and for limiting accumulation of lint on overhead surfaces above the work area, said lint control apparatus comprising a cylindrical filter housing adapted to be supported at one axial end on a floor surface of the work area, said filter housing having a permeable circumferential periphery defining an air inlet into said housing and having an air outlet formed coaxially with the other axial end of said housing, said filter housing including a cylindrical baffle depending coaxially therewithin from said other axial end of said filter housing in communication with said air outlet to an inlet end of said baffle at a relatively close spacing to said one axial end of said filter housing to be relatively closely spaced to the work area floor surface, lint filtering media covering said air inlet circumferentially about said filter housing, fan means mounted coaxially with said air outlet of said filter housing for drawing ambient air from the work area generally radially through said filter media and exhausting the air upwardly through said baffle and said air outlet of said filter housing, said filter media being adapted to separate airborne lint from the ambient air and collect the separated lint for disposal, said baffle being effective to generally concentrate the ambient air draw of said fan means along the work area floor surface, and generally upstanding duct means mounted coaxially with said air outlet of said filter housing and said fan means in communication therewith for directing the exhausted air upwardly at overhead surfaces to blow accumulated lint off the overhead surfaces and limit further lint accumulation thereon, said duct means including movable deflector means at an upper discharge end and means for moving said deflector means in a predetermined course to direct the exhausted air over a predetermined overhead area.

13. Lint control apparatus according to claim 12 and characterized further in that said deflector means is arranged for pivotal movement, said moving means being arranged for pivotably reciprocating said deflector means in a back-and-forth pattern.

14. Lint control apparatus particularly adapted for collecting airborne lint from a work area in a textile plant, and for limiting accumulation of lint on overhead surfaces above the work area, said lint control apparatus comprising a filter housing defining an air inlet and an air outlet, lint filtering media covering said air inlet, fan means for drawing ambient air from the work area through said filter media and exhausting the air through said air outlet, said filter media being adapted to separate airborne lint from the ambient air and collect the separated lint for disposal, said filter housing being adapted to be floor-supported in the work area for disposition of said air inlet adjacent the work area floor, said filter housing including means for concentrating the ambient air draw of said fan means along the work area floor, and duct means communicating with said air outlet of said filter housing for directing the air exhausted upwardly at overhead surfaces to blow accumulated lint off the overhead surfaces and limit further lint accumulation thereon.

15. Lint control apparatus according to claim 14 and characterized further in that said concentrating means comprises a tubular baffle extending within said filter housing from said air outlet to an inlet end of said baffle disposed generally centrally of said air inlet at a relatively close spacing to the work area floor, said fan means being arranged in communication with the interior of said baffle.

16. Lint control apparatus particularly adapted for collecting airborne lint from a work area in a textile plant, and for limiting accumulation of lint on overhead surfaces above the work area, said lint control apparatus comprising a filter housing defining an air inlet and an air outlet, lint filtering media covering said air inlet, fan means for drawing ambient air from the work area through said filter media and exhausting the air through said air outlet, said filter media being adapted to separate airborne lint from the ambient air and collect the separated lint for disposal, and duct means communicating with said air outlet of said filter housing for directing the air exhausted upwardly at overhead surfaces to blow accumulated lint off the overhead surfaces and limit further lint accumulation thereon, said duct means including movable deflector means at an upper discharge end for selective changeability of the upward direction of the exhausted air and means for moving said deflector means in a predetermined course to direct the exhausted air over a predetermined overhead area.

17. Lint control apparatus according to claim 16 and characterized further in that said deflector means is arranged for pivotal movement, said moving means being arranged for pivotably reciprocating said deflector means in a back-and-forth pattern.

* * * * *